US005278365A

United States Patent [19]

Rowley et al.

[11] Patent Number: 5,278,365

[45] Date of Patent: Jan. 11, 1994

[54] WALL SWITCH LATCH ARRANGEMENT

[76] Inventors: Bruce L. Rowley, 4979 Keppler Rd., Temple Hills, Md. 20748; Paul Friedman, 9601 Cortland La., Dunkirk, Md. 20754

[21] Appl. No.: 948,110

[22] Filed: Sep. 21, 1992

[51] Int. Cl.[5] ..... H01H 3/20

[52] U.S. Cl. ..... 200/43.16; 200/308

[58] Field of Search ..... 200/43.19, 43.16, 43.11, 200/308

[56] References Cited

U.S. PATENT DOCUMENTS 4,876,425 10/1989 Woskow ..... 200/43.16

5,148,910 9/1992 Williams ..... 200/43.19

*Primary Examiner*—Renee S. Luebke

*Attorney, Agent, or Firm*—Leon Gilden

[57] ABSTRACT

A wall switch latch includes a mounting plate having an enclosed slot directed therethrough and slidably receiving a fastener member directed into a wall plate permitting an abutment plate mounted to the mounting plate for abutment with an associated actuating lever bar of a wall switch mechanism. The abutment plate further includes a fluid dye saturated sponge arranged to mark the lever bar of the switch upon contact therewith.

1 Claim, 3 Drawing Sheets

WALL SWITCH LATCH ARRANGEMENT

BACKGROUND OF THE INVENTION

1. Field of the Invention

The field of invention relates to wall switch locking structure, and more particularly pertains to a new and improved wall switch latch arrangement wherein the same is arranged for selective abutment with a wall switch actuating lever bar preventing unauthorized and inadvertent movement of the lever bar.

2. Description of the Prior Art

Typically to provide for protecting a switch plate relative to a wall is indicated in U.S. Pat. No. 3,518,356 to Friedman providing for a cover structure relative to a latch bar of a switch member. To maintain the latch bar either in an opened or closed configuration and prevent inadvertent switching on or off of the mechanism, which is desired in typical office building and the like or in rooms where maintaining lights and operative illumination is desired, the instant invention utilizes an abutment bar structure mounted to a wall switch plate to provide for selective abutment of the actuating lever bar permitting its displacement relative to the plate. Prior art has heretofore failed to provide for the ease of such construction and in this respect, the present invention substantially fulfills this need.

SUMMARY OF THE INVENTION

The present invention provides a wall switch latch arrangement wherein the same is operative in combination with a wall switch plate structure to prevent inadvertent displacement of an actuating lever bar directed through a wall switch plate opening. As such, the general purpose of the present invention, which will be described subsequently in greater detail, is to provide a new and improved wall switch latch arrangement which has all the advantages of the prior art wall switch structure and none of the disadvantages.

To attain this, the present invention provides a wall switch latch including a mounting plate having an enclosed slot directed therethrough and slidably receiving a fastener member directed into a wall plate permitting an abutment plate mounted to the mounting plate for abutment with an associated actuating lever bar of a wall switch mechanism.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is another object of the present invention to provide a new and improved wall switch latch arrangement which may be easily and efficiently manufactured and marketed.

It is a further object of the present invention to provide a new and improved wall switch latch arrangement which is of a durable and reliable construction.

An even further object of the present invention is to provide a new and improved wall switch latch arrangement which is susceptible of a low cost of manufacture with regard to both materials and labor, and which accordingly is then susceptible of low prices of sale to the consuming public, thereby making such wall switch latch arrangements economically available to the buying public.

Still yet another object of the present invention is to provide a new and improved wall switch latch arrangement which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
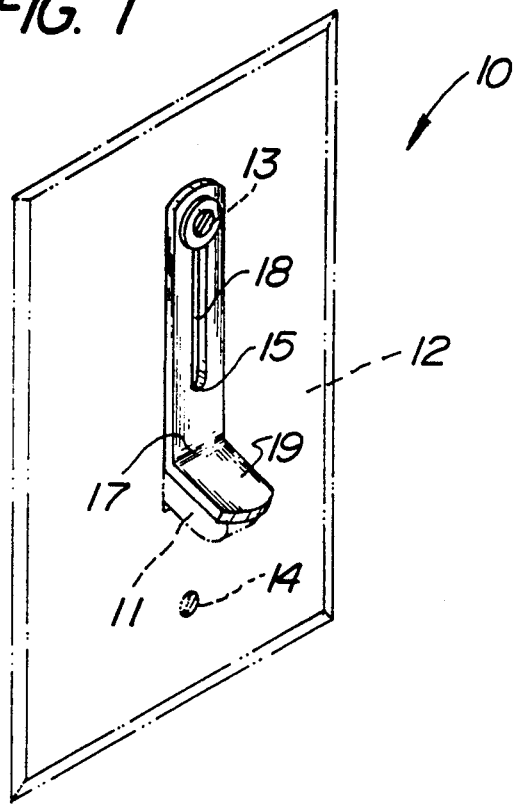
FIG. 1 is an isometric illustration of the instant invention.
Figure 2:
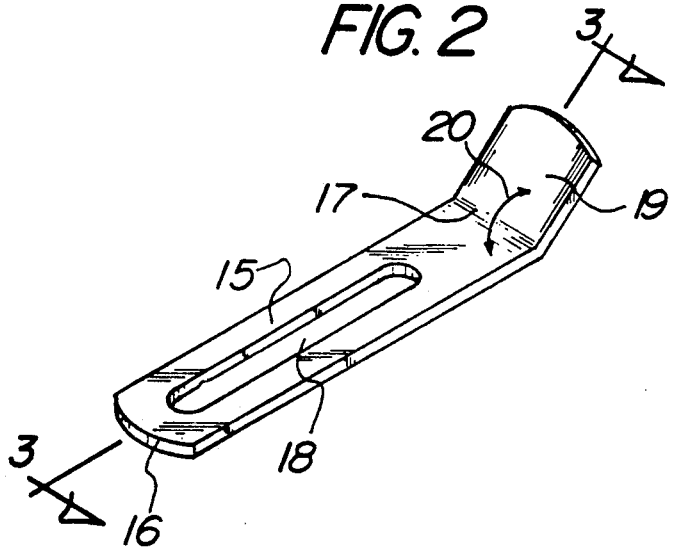
FIG. 2 is an isometric view of the latch plate.
Figure 3:
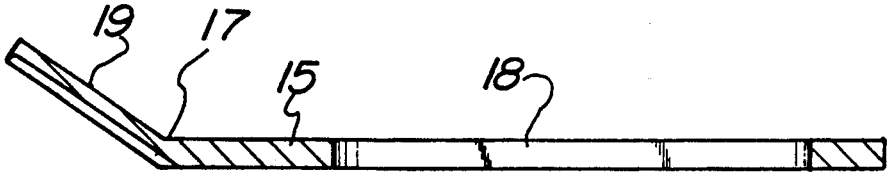
FIG. 3 is an orthographic view taken along the lines 3—3 of FIG. 2 in the direction indicated by the arrows.

With reference now to the drawings, and in particular to FIGS. 1 to 7 thereof, a new and improved wall switch latch arrangement embodying the principles and concepts of the present invention and generally designated by the reference numerals 10 and 10*a* will be described.

More specifically, the wall switch latch arrangement 10 of the instant invention essentially comprises a wall switch actuating lever bar 11 of a conventional wall switch member directed through a wall switch plate 12, and more specifically through a plate opening. On opposed sides of the plate opening are respective first and second mounting screws 13 and 14. A planar mounting plate 15 is provided having a plate first end 16 spaced from a plate second end junction line 17, with an enclosed slot directed through the mounting plate 15 orthogonally oriented relative to the junction line 17. The first mounting screw 13 is directed through the enclosed slot 18, whereupon selective tightening of the first mounting screw 13 provides for tightening and securement of the mounting plate relative to the wall switch plate 12. An abutment plate 19 is fixedly mounted to the second end junction line 17 having an obtuse included angle 20 oriented between the abutment plate 19 and the mounting plate 15. In this manner, as illustrated in FIG. 1, selective positioning of the lever bar 11 relative to the wall switch plate 12 is provided.

Figure 4:
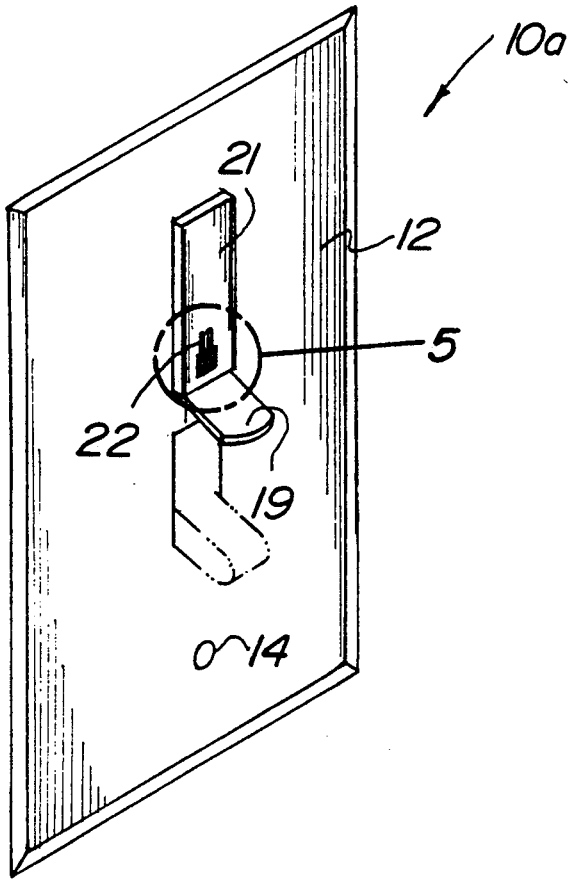
FIG. 4 is an isometric illustration of the invention utilizing the plate mounted within a tubular sleeve.
Figure 5:
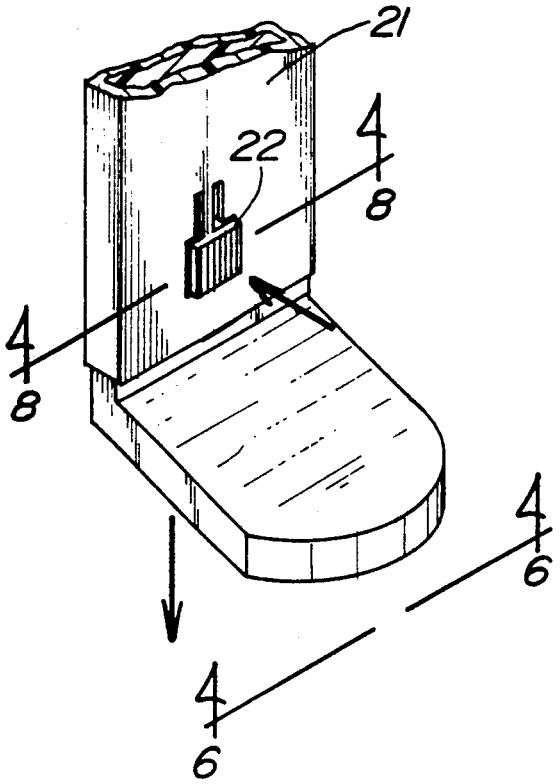
FIG. 5 is an enlarged isometric illustration of section 5 as set forth in FIG. 4.
Figure 6:
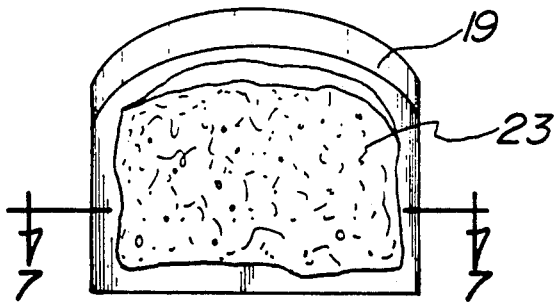
FIG. 6 is an orthographic view, taken along the lines 6—6 of FIG. 5 in the direction indicated by the arrows.
Figure 7:
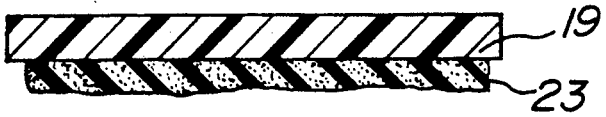
FIG. 7 is an orthographic view, taken along the lines 7—7 of FIG. 6 in the direction indicated by the arrows.

The FIGS. 4 and 5 indicate the use of a tubular sleeve body 21 having a latch button 22 for selective communication with the slot 18 to provide for selective reception of the mounting plate within the tubular body permitting selective retraction of the abutment plate 19 as desired. Further, a fluid dye saturated sponge member 23 is mounted to the abutment plate in facing relationship relative to the lever bar 11, wherein projection of the sponge member 23 onto the lever bar 11 imposes imprinting of a coloration dye onto the lever bar to indicate the need for positioning the abutment plate relative to and in abutment with the lever bar 11 to further emphasize the need for latching the lever bar 11 in a predetermined orientation, such as indicated in FIG. 1 and returning the abutment plate 19 to an operative communication with the lever bar.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A wall switch latch arrangement, comprising in combination, a wall switch plate, the wall switch plate having a plate opening, with a wall switch having a lever bar directed through the opening, and latch means mounted to the wall switch plate for selective abutment with the lever bar, and the latch means includes a planar mounting plate, and the wall switch plate includes a first mounting screw directed through the wall switch plate adjacent a first end of the plate opening, and a wall switch plate second mounting screw directed through the wall switch plate adjacent a second end of the plate opening, with the mounting plate having a plate first end spaced from a plate second end junction line, and an enclosed slot directed through the mounting plate orthogonally oriented relative to the second end junction line, with the first mounting screw directed through the enclosed slot, and an abutment plate fixedly mounted to the second end junction line, with the abutment plate oriented at an obtuse included angle relative to the mounting plate, and the abutment plate arranged for selective abutment with the lever bar, and the abutment plate includes a fluid dye saturated sponge member arranged to impart a marking upon the lever bar upon imposing the abutment plate in contiguous communications with the lever bar.

* * * * *